US009213294B2

(12) United States Patent
Saito

(10) Patent No.: US 9,213,294 B2
(45) Date of Patent: Dec. 15, 2015

(54) TONE CORRECTION PROCESS THAT CORRECTS TONE OF IMAGE FORMED BY IMAGE FORMING APPARATUS

(71) Applicant: CANON KABUSHIKI KAISHA, Tokyo (JP)

(72) Inventor: Makoto Saito, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/471,167

(22) Filed: Aug. 28, 2014

(65) Prior Publication Data

US 2015/0063843 A1 Mar. 5, 2015

(30) Foreign Application Priority Data

Sep. 5, 2013 (JP) ..... 2013-184339
Aug. 7, 2014 (JP) ..... 2014-161898

(51) Int. Cl.
*G03G 15/00* (2006.01)

(52) U.S. Cl.
CPC ..... *G03G 15/556* (2013.01); *G03G 15/5058* (2013.01)

(58) Field of Classification Search
None
See application file for complete search history.

(56) References Cited

U.S. PATENT DOCUMENTS 6,987,934 B2 1/2006 Bessho et al.
2004/0197110 A1* 10/2004 Bessho et al. ..... 399/27

FOREIGN PATENT DOCUMENTS

JP 2004-271834 A 9/2004

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image forming unit forms an electrostatic latent image on an image carrier based on image data converted by a conversion unit, and the image is developed by a developing portion using toner. A replenishment control unit controls an amount of the toner with which the developing portion is replenished based on a toner density in the developing portion so that the toner density in the developing portion reaches a target density. A first determination unit determines a target density based on a result of a first measurement image being measured. A correction unit corrects conversion conditions based on a result of measuring a second measurement image and a correction condition. A second determination unit determines the correction condition based on the target density determined by the first determination unit.

15 Claims, 12 Drawing Sheets

TONE CORRECTION PROCESS THAT CORRECTS TONE OF IMAGE FORMED BY IMAGE FORMING APPARATUS

BACKGROUND OF THE INVENTION

1. Field of the Invention

The present invention relates to tone correction processes that correct the tone of images formed by an image forming apparatus.

2. Description of the Related Art

Electrophotographic image forming apparatuses include developing units that hold two-component developer containing a nonmagnetic toner and a magnetic carrier. Such an image forming apparatus forms images using the toner held in the developing unit. By controlling a ratio of toner mass to the total mass of the developing material held in the developing unit (called a "T/D ratio" hereinafter) to achieve a target ratio, the image forming apparatus controls the density of the images it forms to achieve a target density. This control is referred to as Automatic Toner Replenishment (ATR) control.

Japanese Patent Laid-Open No. 2004-271834 discloses an image forming apparatus that controls an amount of toner with which a developing unit is replenished based on a result of measuring a measurement image in order to control the T/D ratio of developing material held in the developing unit to achieve a target ratio.

The image forming apparatus expresses the tone of images using an area coverage modulation method. For example, the image forming apparatus detects a measurement image formed using predetermined process conditions and then executes tone correction control that generates conversion conditions for converting image data based on a result of the detection.

Although the T/D ratio is adjusted through the ATR control, toner scatter will occur with ease if the T/D ratio exceeds an upper limit value. This can result in the interior of the image forming apparatus being soiled by toner, images becoming fogged and soiled, and so on. On the other hand, carrier adhesion will occur if the T/D ratio drops below a lower limit value. Carrier adhesion is a phenomenon in which the carrier is developed along with the toner. If carrier adhesion occurs, image problems in which the image appears patchy can occur as a result. Accordingly, the T/D ratio is adjusted so as not to exceed or drop below the upper limit value and the lower limit value, respectively. The upper limit value and the lower limit value will be referred to as "T/D ratio limiters".

However, in the case where the T/D ratio is restricted to the upper limit value, it may become impossible to suppress the toner from taking on excessively high charge. On the other hand, in the case where the T/D ratio is restricted to the lower limit value, it may become impossible to increase the toner charge amount to a target amount. In this manner, ATR control cannot correct the T/D ratio beyond the T/D ratio limiters, making it impossible to control the toner charge amount to the target amount; as a result a difference between a density of an output image and a target density may increase.

SUMMARY OF THE INVENTION

The present invention reduces a difference between a density of an output image and a target density.

The present invention provides an image forming apparatus comprising the following elements. A conversion unit is configured to convert image data using a conversion condition. An image forming unit is configured to form an image on an image carrier based on the image data converted by the conversion unit. The image forming unit includes a developing portion configured to, using toner, develop an electrostatic latent image formed based on the image data converted by the conversion unit. A detection unit is configured to detect a toner density in the developing portion. A replenishment control unit is configured to, based on a result of the detection performed by the detection unit, control an amount of toner the developing portion is replenished with so that the toner density in the developing portion reaches a target density. A measurement unit is configured to measure a measurement image formed on the image carrier by the image forming unit. A first determination unit is configured to cause the image forming unit to form a first measurement image, cause the measurement unit to measure the first measurement image, and determine the target density based on a result of measuring the first measurement image. A correction unit is configured to cause the image forming unit to form a second measurement image, cause the measurement unit to measure the second measurement image, and correct the conversion condition based on a result of measuring the second measurement image and a correction condition. A second determination unit is configured to determine the correction condition based on the target density determined by the first determination unit.

Further features of the present invention will become apparent from the following description of exemplary embodiments (with reference to the attached drawings).

DESCRIPTION OF THE EMBODIMENTS

Overall Configuration of Image Forming Apparatus

Figure 1:
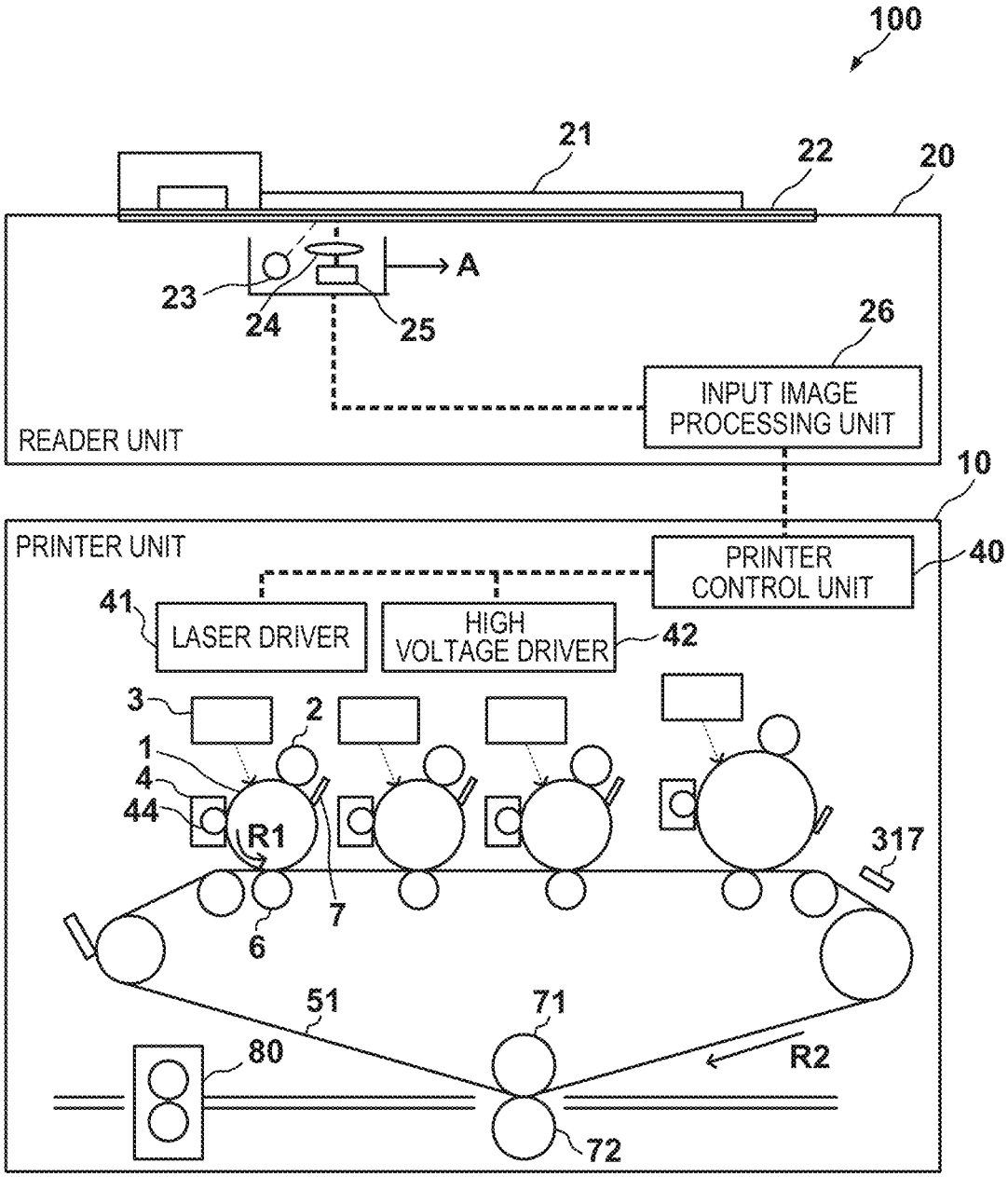
FIG. 1 is an overall cross-sectional view of an image forming apparatus.

FIG. 1 is a diagram illustrating an overall cross-sectional view of an image forming apparatus 100. The image forming apparatus 100 is a copy machine capable of forming multicolor images on sheets (recording paper, OHP sheets, cloth, resin, and the like) using an electrophotographic technique, and includes a printer unit 10 and a reader unit 20.

The printer unit 10 is an example of an image forming unit that forms an image on an image carrier based on image data converted by a conversion unit. The printer unit 10 includes, as image forming units that form toner images, first, second, third, and fourth image forming sections (stations) for forming yellow, magenta, cyan, and black images, respectively. Aside from the toner that is used, each image forming section has the same configuration. A printer control unit 40 controls a laser driver 41, a high voltage driver 42, and the four image forming sections, based on image signals output from the reader unit 20.

Each image forming section is provided with a photosensitive drum 1, which is a cylindrical photosensitive member that serves as an image carrier. The photosensitive drum 1 rotates in the direction of an arrow R1. The surface of the photosensitive drum 1 is charged to a uniform potential by a charging roller 2 that serves as a charging unit. The high voltage driver 42 supplies a predetermined charging voltage to the charging roller 2. A laser beam scanner 3 that serves as an exposure unit forms an electrostatic latent image by irradiating the surface of the photosensitive drum 1 with a beam of light while a light amount is controlled by the laser driver 41. A developing unit 4 is a developing portion that develops the electrostatic latent image using toner; a predetermined developing voltage is supplied thereto from the high voltage driver 42, causing the toner to adhere to the electrostatic latent image and developing the electrostatic latent image into a toner image (a visual image). The developing unit 4 according to the present embodiment holds a two-component developer containing nonmagnetic resin toner particles (toner) as a developing material and magnetic carrier particles (carrier). The developing unit 4 includes a developing sleeve 44 that is disposed opposing the photosensitive drum 1 and that serves as a developing material bearing member. The electrostatic latent image on the photosensitive drum 1 is developed into a toner image by supplying toner to the photosensitive drum 1 from the developing material borne on the developing sleeve 44. A primary transfer roller 6 executes a primary transfer of the toner image onto an intermediate transfer belt 51. The intermediate transfer belt 51 functions as an image carrier and as an intermediate transfer member. Toner that remains following the primary transfer is removed from the surface of the photosensitive drum 1 by a cleaning section 7 that serves as a cleaning unit. The toner image formed on the intermediate transfer belt 51 undergoes a secondary transfer onto a sheet at a secondary transfer roller pair (an inner roller 71 and an outer roller 72). The toner image that has undergone the secondary transfer onto the sheet is fixed onto the sheet by a fixing section 80.

The reader unit 20 is what is known as an image scanner. A light source 23 irradiates a document 21 placed on a document glass 22 with irradiation light. Light reflected by the document 21 forms an image on a CCD sensor 25 via an optical system 24 such as a lens or the like. The CCD sensor 25 is an image sensor that outputs an image signal in accordance with the light reflected by the document 21. In particular, an intensity of the light reflected by the toner image indicates a reflection density (brightness value) of the toner image. A reading section configured of the light source 23, the optical system 24, and the CCD sensor 25 scans the entire document 21 by moving in the direction indicated by an arrow A in FIG. 1 (that is, in a sub scanning direction). An input image processing unit 26 generates image data by converting an analog image signal from the CCD sensor 25 into a digital image signal. The image data is a collection of reflection densities (brightness values). The input image processing unit 26 converts image data configured of RGB brightness values into image data configured of YMCK density values and outputs the image data to the printer control unit 40.

Figure 2:
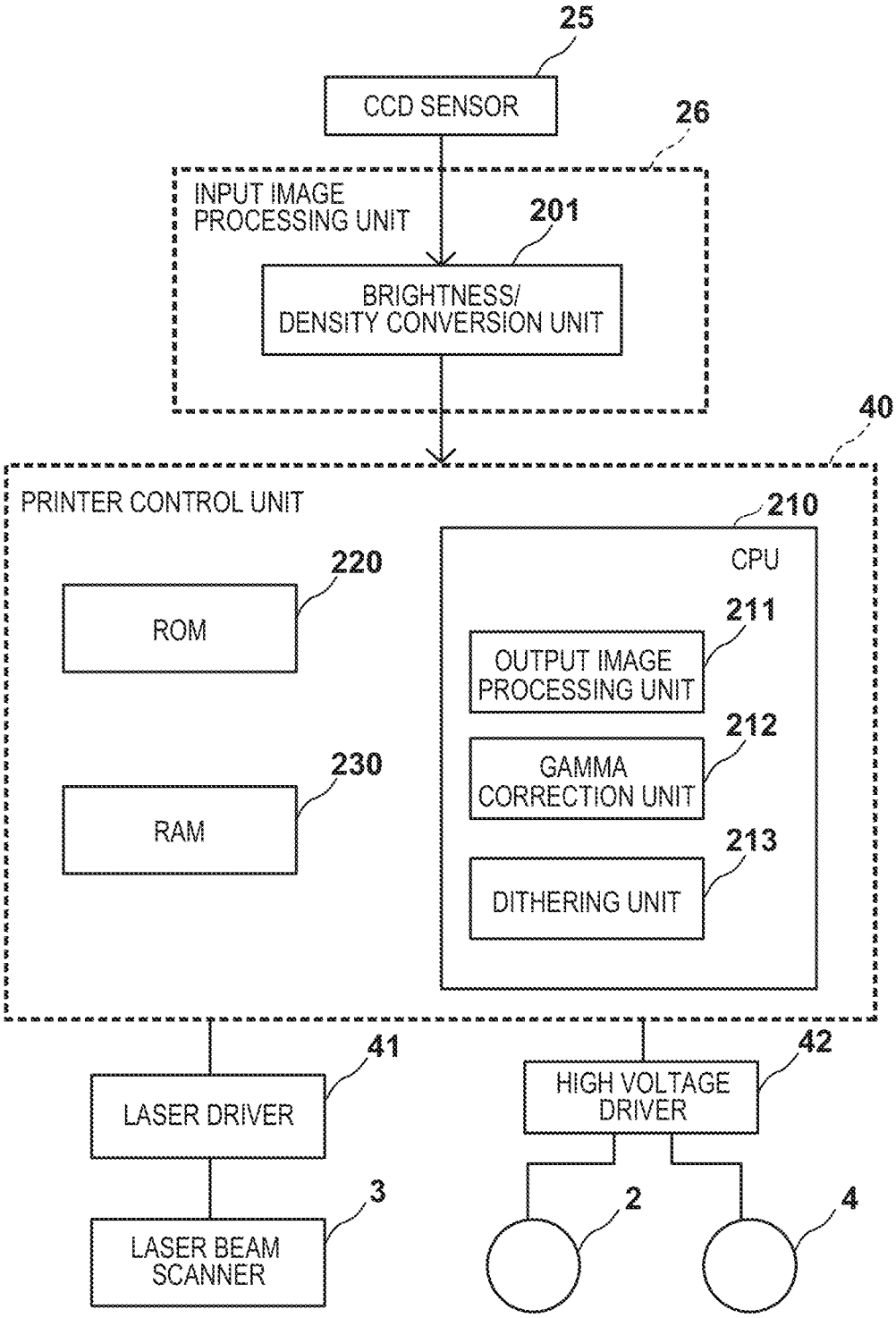
FIG. 2 is a block diagram illustrating functions related to image processing.

FIG. 2 is a block diagram illustrating functions related to image processing. The input image processing unit 26 includes a brightness/density conversion unit 201 that converts the reflection densities (brightness values) in a pattern image formed on a sheet into density values. The printer control unit 40 includes a CPU 210, a ROM 220, and a RAM 230. The CPU 210 realizes various types of functions related to image processing by executing programs stored in the ROM. Note that an ASIC (Application-Specific Integrated Circuit), a DSP (a Digital Signal Processor), or the like may be used along with the CPU 210 or instead of the CPU 210.

The CPU 210 functions as a unit that sets a laser power (exposure amount), which is one example of image forming parameters, in the laser driver 41. For example, based on pattern data or other control data, the CPU 210 sets n laser powers, from a first step to an nth step, sequentially in the laser driver 41. The laser driver 41 controls the laser beam scanner 3 to output the beam of light based on the specified laser power. As a result, an electrostatic latent image serving as the basis of toner images having respectively different image densities is formed on the photosensitive drum 1.

An output image processing unit 211 executes image processing (gamma correction and the like) on density data that has been input from the brightness/density conversion unit 201 as an image signal. For example, the output image processing unit 211 determines a mixing amount for the respective color components of yellow, magenta, cyan, and black so as to output images correctly with the intended coloration. A gamma correction unit 212 corrects gamma properties of an output image using a gamma lookup table (GLUT) for maintaining desired tone characteristics. The GLUT is an example of conversion conditions for converting the image data. The gamma correction unit 212 is an example of a conversion unit that converts image data using conversion conditions. A dithering unit 213 carries out a dithering process for half-tones. For example, the dithering unit 213 selects a dithering pattern corresponding to an input density value and executes the dithering process using the selected dithering pattern. In this manner, the dithering unit 213 functions as a dithering unit that selects a dithering pattern based on a density signal converted using a lookup table and executes a dithering process.

The CPU 210 sets a predetermined charging potential for the photosensitive drum 1 in the high voltage driver 42. The high voltage driver 42 applies a charging voltage to the charging roller 2 so that the specified charging potential is achieved. The CPU 210 sets a predetermined developing potential in the high voltage driver 42. The high voltage driver 42 applies the developing voltage to the developing sleeve 44 of the developing unit 4 so that the specified developing potential is achieved.

Maximum Density Control

Figure 3:
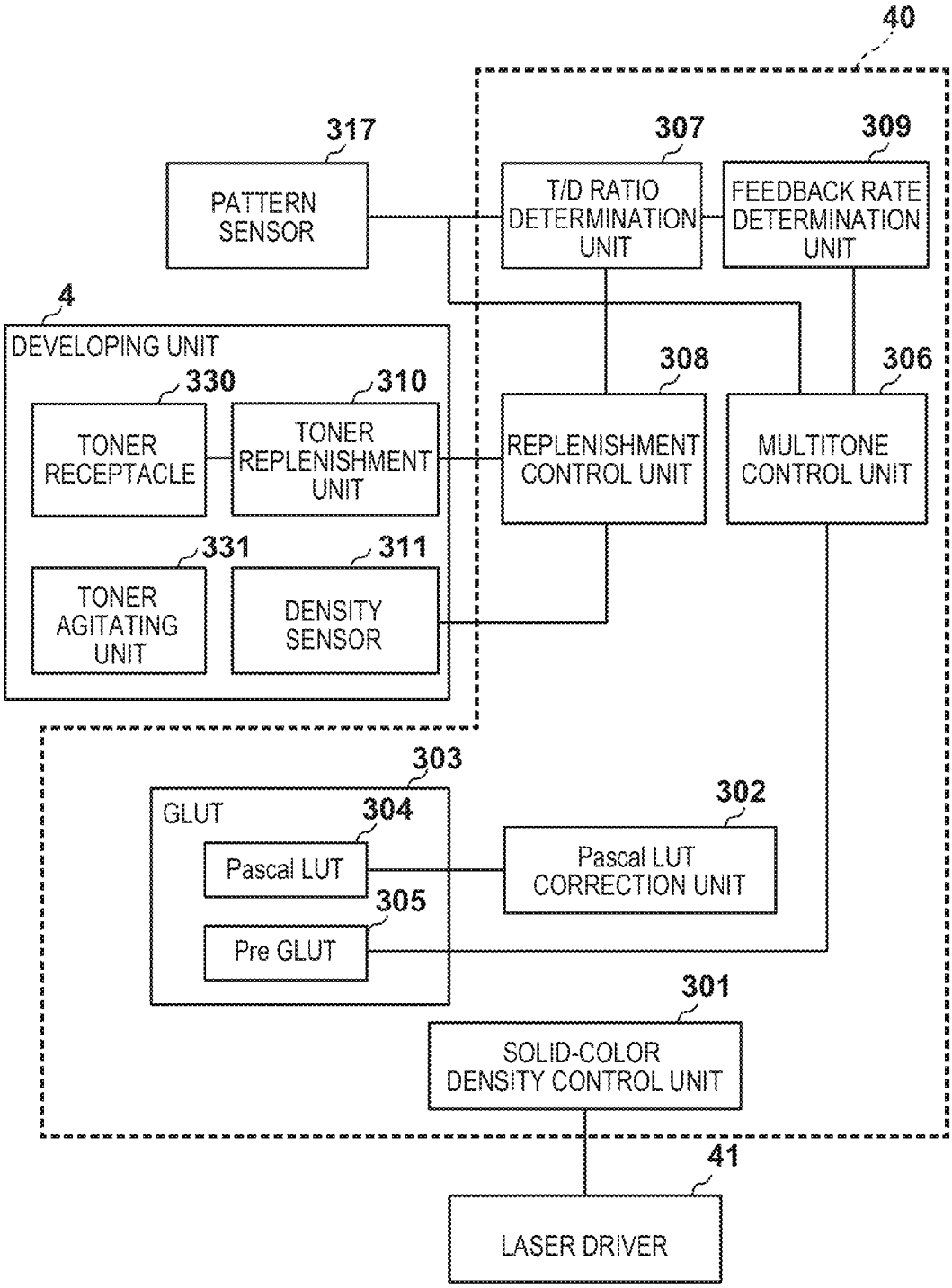
FIG. 3 is a block diagram illustrating functions related to control of image forming conditions.

FIG. 3 is a block diagram illustrating functions related to control of image forming conditions. A solid-color density control unit 301 is a unit that controls a maximum density to a desired density by forming a reference chart on a sheet and reading the reference chart using the reader unit 20.

Figure 4:
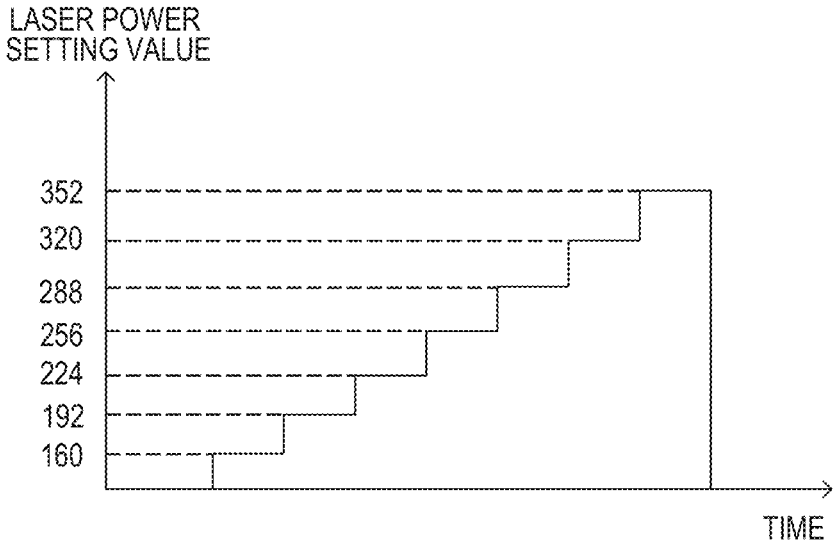
FIG. 4 is a diagram illustrating an example of a laser power setting value.
Figure 5:
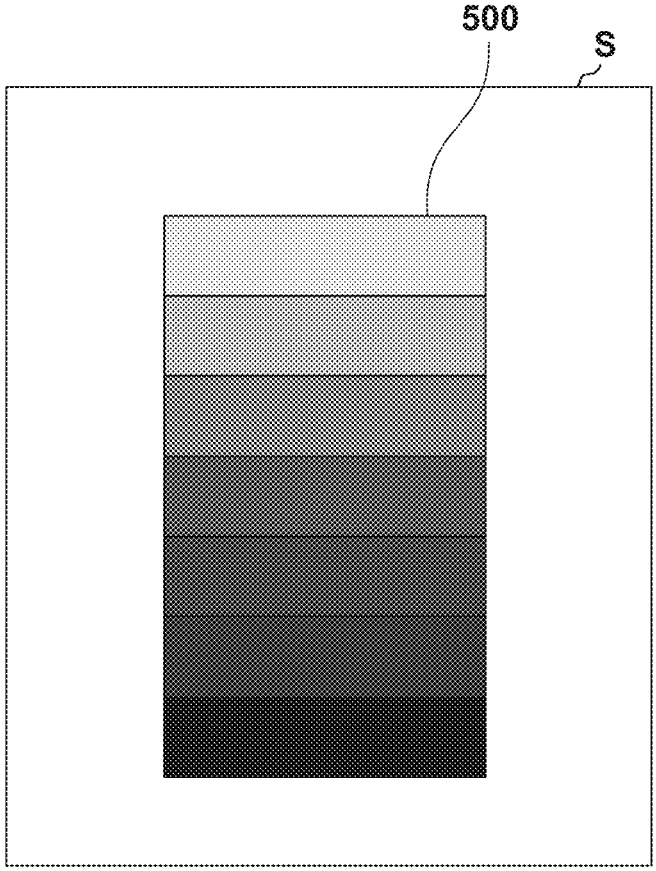
FIG. 5 is a diagram illustrating an example of a reference chart.

By controlling the high voltage driver 42, the solid-color density control unit 301 charges the surface of the photosensitive drum 1 so that the surface potential thereof reaches a predetermined dark area potential and also applies a predetermined developing voltage to the developing sleeve 44 of the developing unit 4. The dark area potential of the drum is −700 V and a DC component of the developing potential is −600 V, for example. In this state, the solid-color density control unit 301 forms a plurality of solid pattern images within an A3-size range by varying the laser power (exposure amount) across a plurality of steps. FIG. 4 illustrates an example of setting values output to the laser driver 41 by the solid-color density control unit 301 when the laser power is varied across seven steps. In this example, the laser power setting values are expressed in 9 bits. That is, the maximum laser power setting value is 511, and the remaining seven setting values are therefore 160, 192, 224, 256, 288, 320, and 352. FIG. 5 illustrates a reference chart 500 formed using these setting values. As shown in FIG. 5, the reference chart 500 has seven solid pattern images whose densities differ according to the laser power (exposure amount).

The reader unit 20 reads the reference chart 500 placed on the document glass 22 and detects the brightness value of each solid pattern image. The input image processing unit 26 then converts the brightness values into density values and sends the density values to the output image processing unit 211 of the printer control unit 40.

Figure 6:
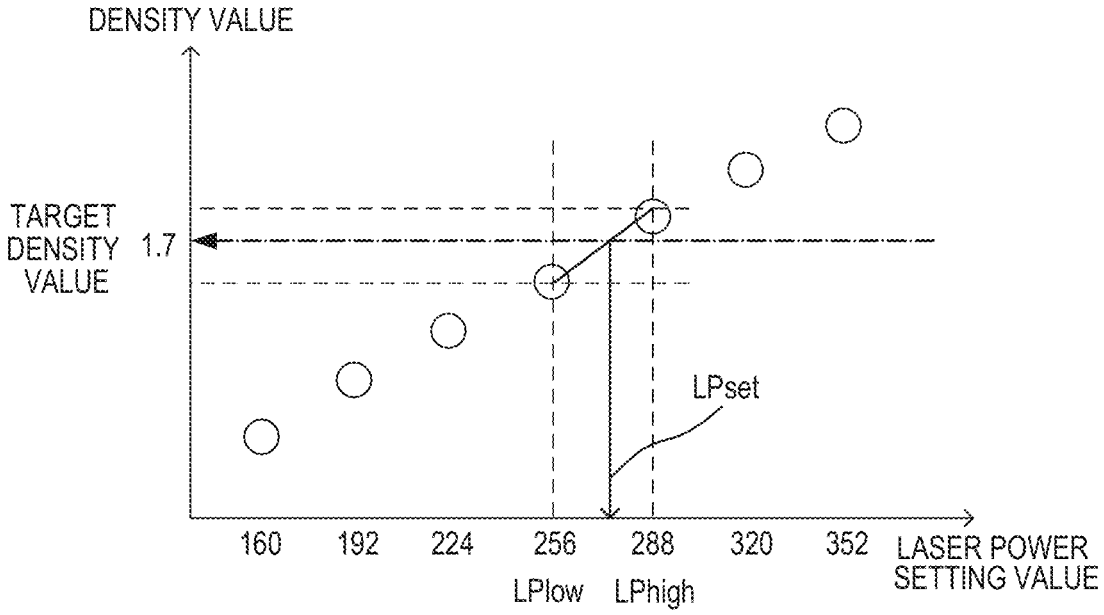
FIG. 6 is a diagram illustrating a relationship between the laser power setting value and a density value.

Each of the density values in the seven solid pattern images is stored in association with the laser power setting value used when the printer unit 10 forms that solid pattern image. FIG. 6 illustrates data indicating a relationship between the density values in the solid pattern images and the laser power setting values. The solid-color density control unit 301 compares the density value (measured value) in each solid pattern image with a target density value and searches out measured values that exceed the target density value. For example, the solid-color density control unit 301 compares the measured value corresponding to a setting value with the target density value, in order from the lowest setting value to the highest setting value. The solid-color density control unit 301 then takes the laser power setting value corresponding to the measured value that exceeds the target density value as LPhigh, and takes the laser power setting value one step lower than LPhigh as LPlow. At this time, the solid-color density control unit 301 calculates a laser power setting value LPset corresponding to the target density value by performing linear interpolation using two points, namely a measured density value corresponding to the setting value LPlow and a measured density value corresponding to the setting value LPhigh. As shown in FIG. 6, the target density value is set to 1.7, for example. Note, however, that the target density value is not limited to this value.

Meanwhile, in the case where all of the measured density values are lower than the target density value, the solid-color density control unit 301 takes the laser power setting value whose measured density value is highest as LPhigh and takes the laser power setting value one step lower than the laser power setting value LPhigh as LPlow. The solid-color density control unit 301 then extrapolates (linearly interpolates) the measured density value corresponding to the laser power setting value LPhigh and the measured density value corresponding to the laser power setting value LPlow, and then calculates the laser power setting value LPset corresponding to the target density value. In the case where all of the measured density values are higher than the target density value, the solid-color density control unit 301 takes the laser power setting value whose measured density value is lowest as LPlow and the laser power setting value one step higher than the laser power setting value LPlow as LPhigh. The solid-color density control unit 301 then extrapolates (linearly interpolates) the measured density value corresponding to the laser power setting value LPhigh and the measured density value corresponding to the laser power setting value LPlow, and then calculates the laser power setting value LPset corresponding to the target density value.

Tone Correction (Pascal LUT Correction)

Once the laser power setting value LPset has been determined, a Pascal LUT correction unit 302 executes tone correction. Once the tone correction has been executed, a gamma lookup table (GLUT) is generated. In other words, the tones of the image formed by the printer unit 10 are corrected to take on target tones. As shown in FIG. 3, a GLUT 303 used by the gamma correction unit 212 is a γLUT obtained by multiplying two lookup tables. A Pascal LUT 304 is a lookup table corrected by the Pascal LUT correction unit 302, and is updated after the maximum density is corrected. A PreGLUT 305 is a lookup table corrected by a multitone control unit 306 during image forming operations, and is corrected frequently through comparison with the Pascal LUT 304. The Pascal LUT 304 corrects long-term tone fluctuations, whereas the PreGLUT 305 corrects short-term tone fluctuations. Note that the multitone control unit 306 is an example of a correction unit that causes the image forming unit to form a second measurement image (example: the pattern image), causes a measurement unit to measure the second measurement image, and corrects the conversion conditions based on a result of measuring the second measurement image and correction conditions (example: a feedback rate).

Figure 7:
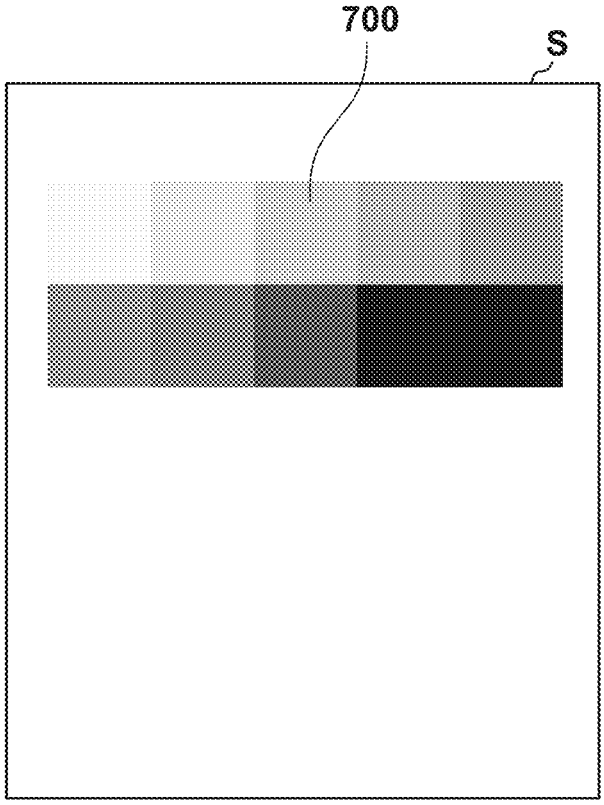
FIG. 7 is a diagram illustrating an example of a tone correction chart.

FIG. 7 is a diagram illustrating an example of a tone correction chart 700 formed on a sheet S when carrying out tone correction. The Pascal LUT correction unit 302 sets a predetermined drum potential in the high voltage driver 42 and sets the laser power setting value LPset in the laser driver 41. The printer unit 10 forms the tone correction chart 700 using process conditions that have been set. The tone correction chart 700 includes ten pattern images, generated using black toner, that have mutually different densities. Each pattern image is an image that has undergone dithering by the dithering unit 213 using a dithering pattern based on the density value. "Dithering pattern" refers to a method for disposing halftone dots, or in other words, how sparse the halftone dots are and the size of the halftone dots. Hereinafter, it is assumed that the Pascal LUT correction unit 302 generates the tone correction chart 700 by controlling the output image processing unit 211, the gamma correction unit 212, and the dithering unit 213.

Furthermore, it is assumed that the output image processing unit 211 handles density information input from the input image processing unit 26 in an 8-bit resolution. The maximum density is thus expressed as FF in hexadecimals. Here, ten steps' worth of dithering patterns corresponding to FF, E0, C0, A0, 90, 80, 60, 40, 20, and 10, which are the signal values indicating ten steps' worth of density information, are prepared. In other words, the ten steps' worth of dithering patterns are specified by the respective signal values of FF, E0, C0, A0, 90, 80, 60, 40, 20, and 10. The output image processing unit 211 outputs, to the gamma correction unit 212, the signal values corresponding to the ten steps' worth of density information that has been input. The gamma correction unit 212 converts the input density signals by referring to the GLUT 303, and outputs the converted signals to the dithering unit 213. Note that when the tone correction is performed using the reader unit 20, the GLUT 303 may output a signal value (input signal) corresponding the density information as a density signal (output signal) to the dithering unit 213 without correcting the signal value. The dithering unit 213 selects a dithering pattern corresponding to the converted density signals and executes the dithering process. The printer unit forms the tone correction chart 700 on the sheet S based on the image data (measurement image data) that has undergone the dithering.

In the case where the user has placed the tone correction chart 700 on the document glass 22 of the reader unit 20 and instructed the tone correction chart 700 to be read using an operating unit (not shown), the reader unit 20 measures the brightness values of the tone correction chart 700. The input image processing unit 26 then converts the brightness values of the tone correction chart 700 into density values using the brightness/density conversion unit 201, and outputs the density values to the printer control unit 40. The Pascal LUT correction unit 302 generates the Pascal LUT 304 so that the density value of each pattern image matches the target density value and stores the Pascal LUT 304 in the RAM 230.

After the tone correction is performed using the reader unit 20, the GLUT 303 us updated based on the GLUT 303, the Pascal LUT 304 and the PreGLUT 305. In this case, the Pascal LUT correction unit 302 set one with a correction coefficient of the PreGLUT 305 such that the PreGLUT 305 converts the input signal into the output signal without correcting the input signal. Note that when the gamma correction unit 212 does not convert the density signal based on the GLUT 303 in order to perform the tone correction, the GLUT 303 is created based on the Pascal LUT 304 and the PreGLUT 305.

Note that the density of images formed by the printer unit 10 also varies depending on environmental conditions (temperature, humidity), the number of pages to be printed, and so on, and it is therefore necessary to periodically correct the GLUT 303. However, it is necessary to print the tone correction chart 700 in order to correct the Pascal LUT 304, which consumes sheets, places a burden on a user by requiring the user to place the tone correction chart 700 on the document glass 22, and so on. Accordingly, the image forming apparatus 100 corrects the PreGLUT 305 without using the tone correction chart 700, and updates the GLUT 303 based on the Pascal LUT 304 and the PreGLUT 305. Through this, the image forming apparatus 100 can reduce the burden involved with the user placing the tone correction chart 700 on the document glass 22 while also keeping the image density at an appropriate density.

PreGLUT Correction

Figure 11A:
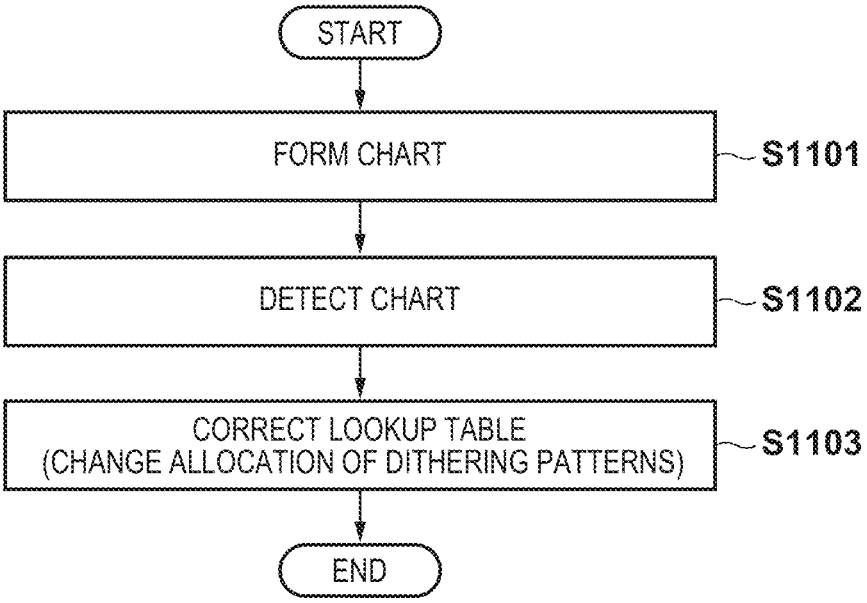
FIG. 11A is a flowchart illustrating multitone control.

Density correction (multitone control), through which the multitone control unit 306 corrects the PreGLUT 305 during image forming operations, will be described based on FIG. 11A. The density correction is control in which the multitone control unit 306 causes the printer unit 10 to form a plurality of pattern images having different tones on the intermediate transfer belt 51, causes a pattern sensor 317 to detect the densities of the pattern images, and corrects the PreGLUT 305 based on the results of detecting the pattern images. Note that the pattern sensor 317 is an example of a measurement unit that measures a measurement image formed on an image carrier by an image forming unit. The CPU 210 updates the GLUT 303 based on the PreGLUT 305. In this manner, the multitone control unit 306 functions as a control unit that controls image forming conditions (example: allocation of dithering patterns) by feeding back the density value of a second toner image formed upon the intermediate transfer belt 51.

Figure 8:
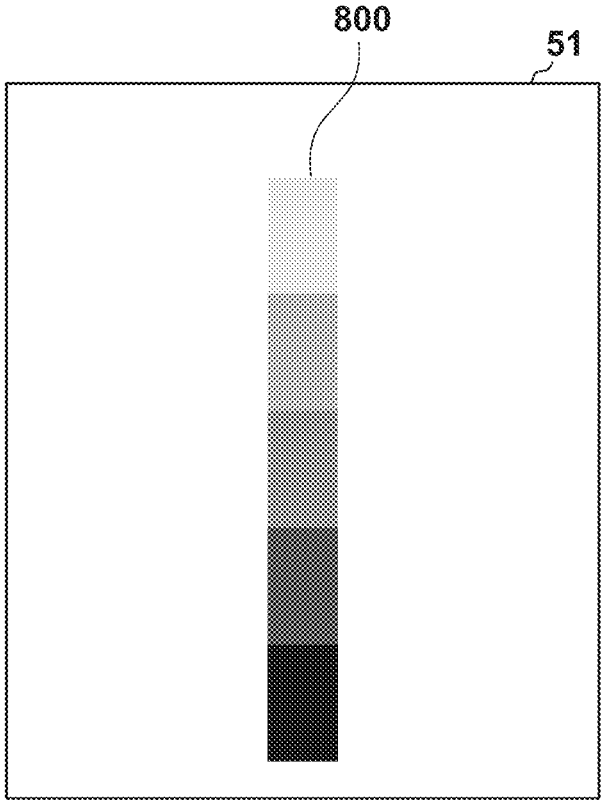
FIG. 8 is a diagram illustrating an example of a tone chart.

In S1101, the multitone control unit 306 controls the printer unit 10 to form a plurality of pattern images having different tones (a tone chart 800) on the intermediate transfer belt 51. For example, the multitone control unit 306 controls the gamma correction unit 212 and corrects a predetermined five steps' worth of signal values (512, 320, 256, 192, and 128) based on the GLUT 303 held in the RAM 230 immediately before the image formation. Then, the multitone control unit 306 controls the dithering unit 213 to select a dithering pattern corresponding to the signal values corrected by the gamma correction unit 212 and execute the dithering process. As shown in FIG. 8, the tone chart 800, which includes five pattern images, is formed on the intermediate transfer belt 51.

In S1102, the multitone control unit 306 measures the density of each pattern image in the tone chart 800 using the pattern sensor 317, which is disposed in the vicinity of the intermediate transfer belt 51. The pattern sensor 317 outputs signals indicating results of reading each pattern included in the tone chart 800. The pattern sensor 317 is, for example, an optical sensor having a light-emitting portion and a light-receiving portion. Using a conversion table stored in advance, the multitone control unit 306 converts each output signal from the pattern sensor 317 into a density value Dm.

Figure 9:
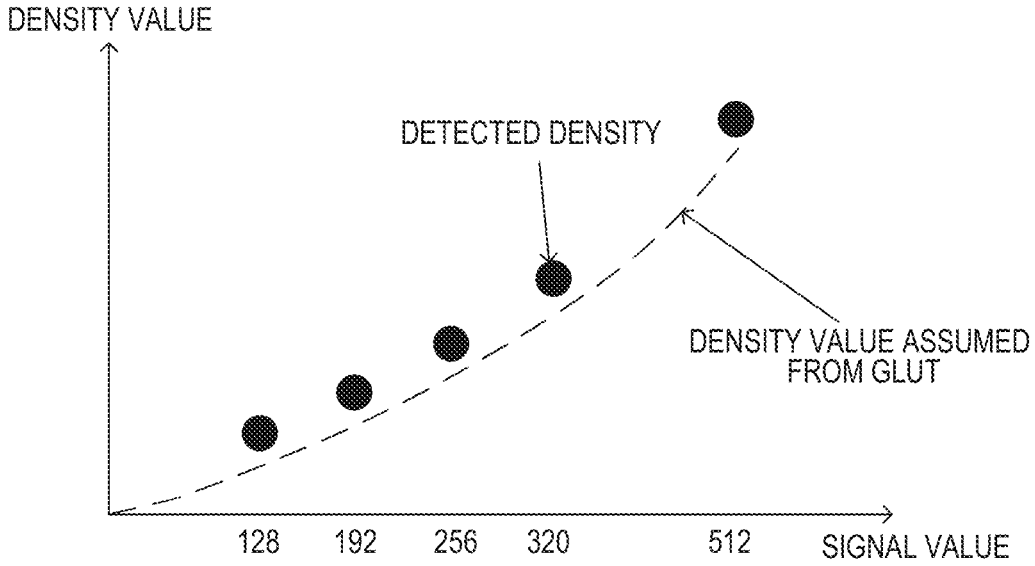
FIG. 9 is a diagram illustrating a relationship between the signal value of a density signal and a density value.

In S1103, the multitone control unit 306 corrects the PreGLUT 305, which is a lookup table. For example, the multitone control unit 306 compares the detected density values Dm with target density values Dt obtained using the GLUT 303. As shown in FIG. 9, the multitone control unit 306 corrects the PreGLUT 305 in the case where a difference between the density values Dm corresponding to the respective signal values (512, 320, 256, 192, and 128) and the density values Dt corresponding to the respective signal values obtained using the GLUT 303 (512, 320, 256, 192, and 128) is greater than a predetermined value. For example, the multitone control unit 306 calculates a difference dΔ, between the density value Dm corresponding to a signal value and the target density value Dt corresponding to a signal value obtained using the GLUT 303, and determines whether or not the difference dΔ exceeds a threshold th. If the difference dΔ exceeds the threshold th, the multitone control unit 306 corrects the PreGLUT 305 so that the difference dΔ is 0 or is no greater than the threshold th. In this manner, the multitone control unit 306 corrects the PreGLUT 305 so as to increase the density of the toner image in the case where the density value obtained by the pattern sensor 317 is lower than the target density value. For example, the multitone control unit 306 changes the dithering pattern allocated to the density signal so as to increase the density of the toner image in the case where the obtained density value is lower than the target density value. Likewise, the multitone control unit 306 corrects the PreGLUT 305 so as to reduce the density of the toner image in the case where the density value obtained by the pattern sensor 317 is higher than the target density value. For example, the multitone control unit 306 changes the dithering pattern allocated to the density signal so as to reduce the density of the toner image in the case where the obtained density value is higher than the target density value.

Note that the multitone control unit 306 may determine whether or not the density value Dm of the maximum density image which is generated using FF as the signal value of the density signal exceeds the desired target density value Dt. Then, in the case where the density value Dm exceeds the desired target density value Dt, the multitone control unit 306 may correct the PreGLUT 305 so that the dithering pattern for maximum density value is replaced with a dithering pattern for a lower density value. This is called LUT trimming. On the other hand, in the case with the density value Dm corresponding to the signal value FF does not meet the desired target density value Dt, the PreGLUT 305 may be corrected so that the dithering pattern for maximum density value (the signal value FF) is replaced with a dithering pattern that can form a higher-density image. The multitone control unit 306 also rearranges the dithering pattern for halftone regions (halftone areas) formed by signal values that are between FF and 0. The multitone control unit 306 calculates a shift amount, which is an amount by which the density values Dm of four levels of halftone areas whose signal values are 320, 256, 192, and 128 are shifted from the target density value Dt. Furthermore, the multitone control unit 306 corrects the PreGLUT 305 so that the shift amount is 0.

Having corrected the PreGLUT 305, the multitone control unit 306 updates the GLUT 303 based on the corrected PreGLUT 305 and the Pascal LUT 304. Note that the multitone control unit 306 counts the number of images that are formed, and executes the multitone control when the counted value reaches a predetermined number (example: 82). The tone chart 800 may be formed in a blank region (between sheets) of the intermediate transfer belt 51, in the area between the following edge of an image corresponding to a given sheet S and the leading edge of an image corresponding to the sheet S that follows thereafter. In other words, the tone chart 800 may be formed on the intermediate transfer belt 51 in a region where no image is formed, between the image for an nth page and the image for an n+1th page. Furthermore, the tone chart 800 may be generated during reverse rotation of the intermediate transfer belt 51, executed after the formation of an image on the sheet S is complete. The counted value of the number of images formed is set to 0 when the developing unit 4, a cartridge mounted in the image forming apparatus 100, or the like is replaced. The cartridge is a unit in which a charging roller, a cleaning blade, and a photosensitive drum are integrated as a single entity.

ATR Control

Determining Target Density Value Dt

Figure 10:
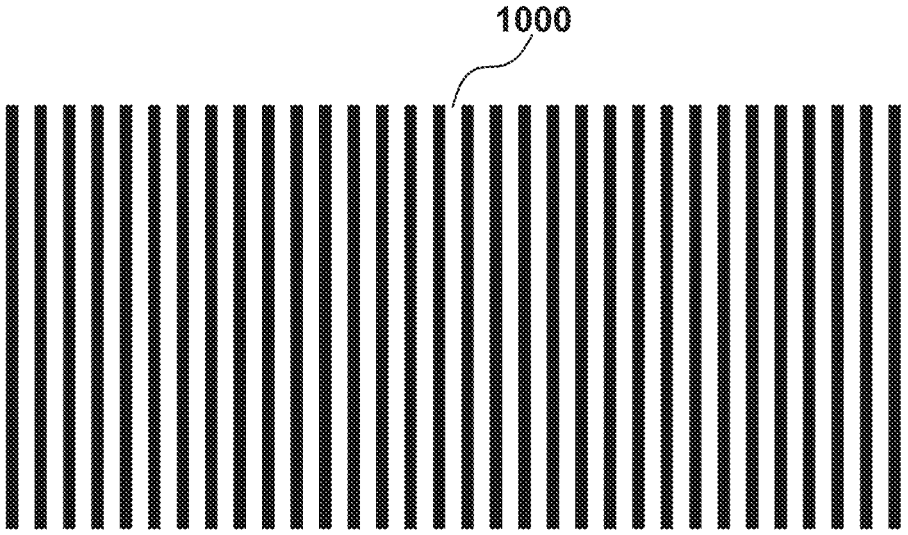
FIG. 10 is a diagram illustrating an example of an ATR chart.

Next, ATR control executed by the CPU 210 of the printer control unit 40 will be described. The process for setting the target density value Dt is executed using a new developing unit and cartridge when the image forming apparatus 100 is installed. A T/D ratio determination unit 307 causes an ATR chart 1000, shown in FIG. 10, to be formed on the intermediate transfer belt 51 by controlling the printer unit 10. The T/D ratio determination unit 307 detects the density of the ATR chart 1000 using the pattern sensor 317. The T/D ratio determination unit 307 then stores the detected density as the target density value Dt of the ATR chart 1000, in the ROM 220.

In the present embodiment, the ATR chart 1000 is a line pattern, having a resolution of 2400 dpi, in which two-dot horizontal parallel lines and one-dot spaces are alternated repeatedly. The dithering unit 213 may employ horizontal parallel lines that correspond to the maximum density value (FF) as the dithering pattern. This is because such a dithering pattern is highly sensitive to phenomena that cause a degradation in developability, such as scraping during rotation of the developing sleeve 44. Note that 256, which is a median value in the 512 levels, is employed as the laser power setting value.

Determining Target T/D Ratio

Figure 11B:
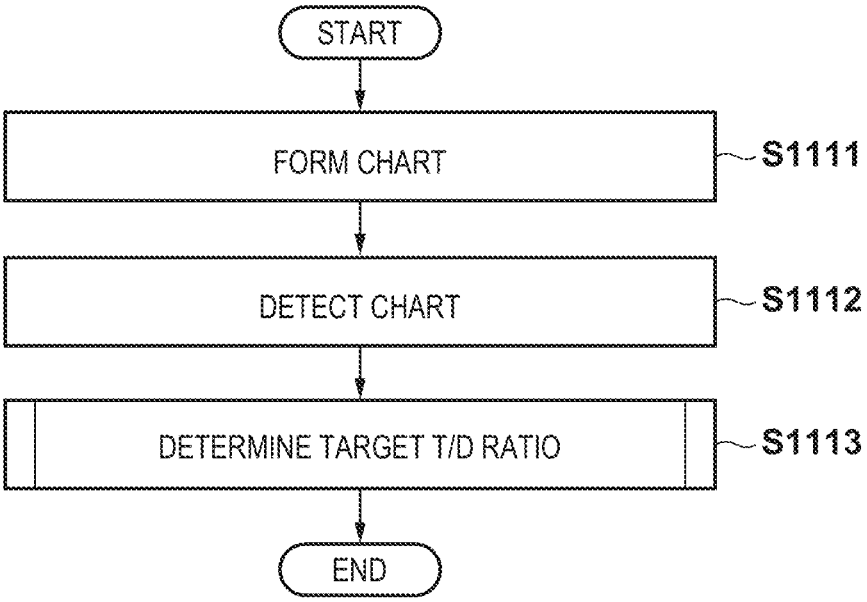
FIG. 11B is a flowchart illustrating a process for determining a target T/D ratio.

A method for determining the target T/D ratio will be described using FIG. 11B. As described above, the T/D ratio is a ratio of toner mass to the total mass of the developing material held in the developing unit. The target T/D ratio is a target value for the ratio of toner to carrier in the developing unit 4, and is updated every predetermined interval of time or the like. In S1111, the T/D ratio determination unit 307 forms the ATR chart 1000 on the intermediate transfer belt 51 by controlling the printer unit 10. In S1112, the T/D ratio determination unit 307 detects the density of each pattern image (see FIG. 10) in the ATR chart 1000 using the pattern sensor 317. In S1113, the T/D ratio determination unit 307 determines the target T/D ratio based on a density value obtained from the ATR chart 1000. For example, the T/D ratio determination unit 307 compares the detected density value (measured value) with the target density value Dtgt held in the ROM 220. If the density value Datr of the ATR chart 1000 is lower than the target density value Dtgt, it is thought that the developability has dropped due to a drop in the toner charge amount. Accordingly, the T/D ratio determination unit 307 corrects the target T/D ratio so as to reduce the T/D ratio in the developing unit 4 and increase the toner charge amount. On the other hand, if the density value Datr of the ATR chart 1000 is higher than the target density value Dtgt, it is thought that the toner charge amount has risen. Accordingly, the T/D ratio determination unit 307 corrects the target T/D ratio so as to increase the T/D ratio in the developing unit 4 and reduce the toner charge amount. The corrected T/D ratio is stored in the RAM 230. The target T/D ratio is used by a replenishment control unit 308 in order to adjust a toner replenishment amount. In this manner, the T/D ratio determination unit 307 functions as a target value determination unit that determines a target value for the T/D ratio in accordance with the density value of a first toner image (the ATR chart 1000) formed on the intermediate transfer belt 51. In other words, the T/D ratio determination unit 307 is an example of a first determination unit that causes the image forming unit to form a first measurement image, causes the measurement unit to measure the first measurement image, and determines the target density based on the result of measuring the first measurement image.

Toner Replenishment Amount Control

Figure 12:
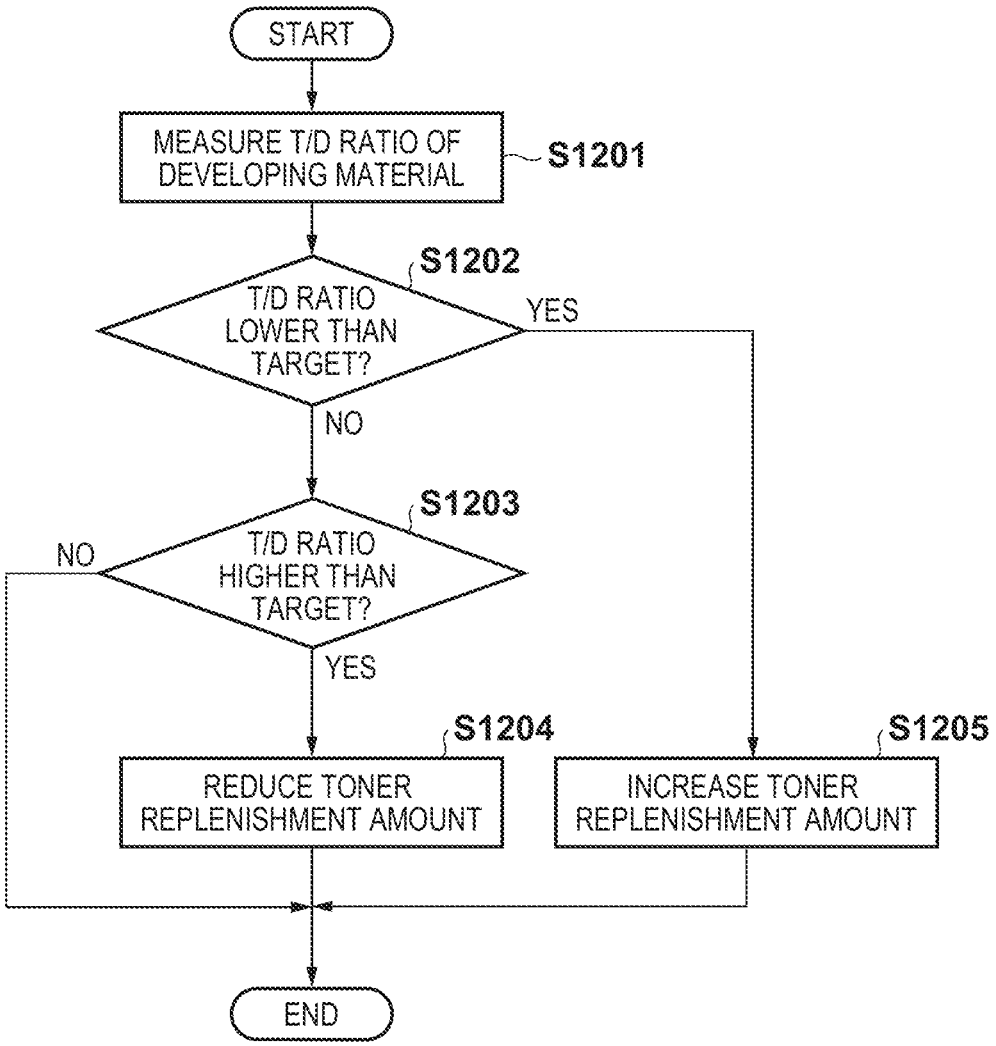
FIG. 12 is a flowchart illustrating toner replenishment amount control.

Toner replenishment amount control will be described using FIG. 12. Note that the replenishment control unit 308 functions as a replenishment amount control unit that controls the amount of toner with which a toner agitating unit 331 in the developing unit 4 is replenished from a toner receptacle 330 based on the ratio of toner to carrier (the T/D ratio) in the developing unit 4.

In S1201, the replenishment control unit 308 measures the T/D ratio of the developing material using a density sensor 311. The density sensor 311 is an example of a detection unit that detects a toner density in the developing portion. For example, the replenishment control unit 308 detects a magnetic permeability of the developing material using the density sensor 311, which is an inductance sensor or the like, and converts the magnetic permeability into the T/D ratio of the developing material within the developing unit 4. In this manner, the density sensor 311 functions as a detection unit that detects the ratio of toner to the developing material held in the developing unit 4 (the toner density). The density sensor 311 may be a magnetic permeability detection unit that detects the magnetic permeability of the developing material in the developing portion. Meanwhile, the replenishment control unit 308 is an example of a replenishment control unit that, based on a result of the detection performed by the detection unit, controls the amount of toner the developing portion is replenished with so that the toner density in the developing portion reaches a target density.

In S1202, the replenishment control unit 308 compares the T/D ratio detected by the density sensor 311 with the target T/D ratio determined by the T/D ratio determination unit 307, and determines whether or not the T/D ratio is lower than the target T/D ratio. The process advances to S1205 if the T/D ratio of the developing material is lower than the target T/D ratio. In S1205, the replenishment control unit 308 increases the toner replenishment amount in a toner replenishing unit 310.

The process advances to S1203 if it is determined in S1202 that the T/D ratio of the developing material is not lower than the target T/D ratio. In S1203, the replenishment control unit 308 determines whether or not the T/D ratio of the developing material is higher than the target T/D ratio. If the T/D ratio of the developing material is higher than the target T/D ratio, it can be said that there is too much toner relative to the carrier, and thus the process advances to S1204. However, the process ends if the T/D ratio of the developing material is not higher than the target T/D ratio.

In S1204, the replenishment control unit 308 reduces the toner replenishment amount in the toner replenishing unit 310. The toner replenishing unit 310 is a mechanism that replenishes the toner agitating unit 331 of the developing unit 4 with toner from the toner receptacle 330. Through this, the T/D ratio of the developing unit 4 can be corrected to the target T/D ratio, and images can be formed using toner whose charge amount has been adjusted to a desired charge amount. Although the magnetic permeability is converted into the T/D ratio here, the magnetic permeability may be used as-is instead. In such a case, the target T/D ratio is converted into a target magnetic permeability and used. The toner agitating unit 331 functions as an agitating unit that agitates the toner and carrier held in the developing unit 4.

T/D Ratio Limiters

In the present embodiment, the T/D ratio determination unit 307 corrects the target T/D ratio so as not to exceed predetermined T/D ratio limiters. In other words, the target T/D ratio is corrected so as not to exceed a given upper limit value and not to drop below a given lower limit value.

In the present embodiment, the upper limit value is set to 9%. The image can be soiled due to toner scatter, fogging, or the like if the target T/D ratio exceeds the upper limit value. On the other hand, the lower limit value is set to 6%. Image problems such as ghosting, carrier adhesion, or the like can occur if the target T/D ratio drops below the lower limit value.

Toner scatter, fogging, ghosting, and so on can be reduced by restricting the target T/D ratio using the T/D ratio limiters in this manner. However, restricting the target T/D ratio can also result in unwanted effects. Namely, there are cases where the toner charge amount cannot be correctly maintained.

Accordingly, in the present embodiment, a feedback rate determination unit 309 changes a feedback rate of the PreGLUT 305 in the case where the target T/D ratio cannot be sufficiently corrected using the T/D ratio limiters. Note that the feedback rate determination unit 309 is an example of a second determination unit that determines correction conditions based on the target density determined by the first determination unit. The PreGLUT 305 corresponds to conversion conditions for converting the image data so that the difference dΔ between the density value Dm for a signal value and the density value Dt obtained using the GLUT 303 is no greater than a threshold. The difference dΔ serves as a feedback amount. The feedback rate is a correction amount, among feedback amounts, that indicates to what degree, relative to the target density value, the density of the image formed after the PreGLUT 305 has been updated is to be corrected. For example, the feedback rate is 5% in the case where the target T/D ratio is within a range from the upper limit value to the lower limit value (a first correction condition). On the other hand, the feedback rate is 10% in the case where the target T/D ratio is outside of the range from the upper limit value to the lower limit value (a second correction condition). In this manner, a correction amount by which the conversion conditions corrected based on the second correction condition corrects a predetermined input value is greater than a correction amount by which the conversion conditions corrected based on the first correction condition corrects the predetermined input value. The feedback rate determination unit 309 determines the feedback rate so that this size relationship holds true. The feedback rate determination unit 309 functions as a feedback rate setting unit that sets the feedback rate to a first value in the case where the target T/D ratio is within a predetermined range and sets the feedback rate to a second value that is greater than the first value in the case where the target T/D ratio is outside of the predetermined range. Meanwhile, in the case where the target T/D ratio is outside of the predetermined range, the feedback rate determination unit 309 may set the feedback rate to the second value, which is greater than the first value, for a lookup table that manages the allocation of dithering patterns.

The multitone control is carried out automatically when a predetermined number of images have been formed. For example, the multitone control is executed each time 82 pages of images have been formed. As such, the multitone control is control that is executed with comparatively high frequency. Accordingly, for example, in the case where a plurality of images are formed consecutively, raising the feedback rate excessively will cause a difference between the density of images form before the multitone control is executed and the density of images formed after the multitone control is executed to increase. In other words, in the case where the PreGLUT 305 is changed excessively due to the frequently-executed multitone control, the color of the image will be corrected excessively.

However, in the case where the target T/D ratio is fixed to the T/D ratio limiters and the T/D ratio of the developing unit 4 cannot be sufficiently corrected, the toner charge amount may become unstable, which may lead to an increase in engine density fluctuations. In such a case, the feedback rate determination unit 309 sets the feedback rate to a relatively higher value than the feedback rate employed in the case where the target T/D ratio is within the range from the upper limit value to the lower limit value. As a result, the PreGLUT 305 can be corrected to a greater degree when executing the multitone control, making it possible to appropriately correct shift in the color of an image even in the case where the toner charge amount cannot be controlled to a desired charge amount.

It is especially easy for the maximum density to become unstable in a situation where the target T/D ratio is fixed to the T/D ratio limiters and cannot be controlled in a variable manner. However, by determining the feedback rate as described above, the maximum density can be stabilized as well. In other words, the feedback rate determination unit 309 sets the feedback rate for the case where the target T/D ratio cannot be controlled in a variable manner to a greater value than the feedback rate for the case where the target T/D ratio can be controlled in a variable manner. Through this, the PreGLUT 305 is corrected appropriately, and thus correction for density shifts across the entire density range, as opposed to just the maximum density, can be executed with certainty. As a result, images can be formed in a stable manner over a long period of time regardless of the usage conditions of the image forming apparatus 100, such as the ratio of printed surface area in the page that is printed.

Figure 13:
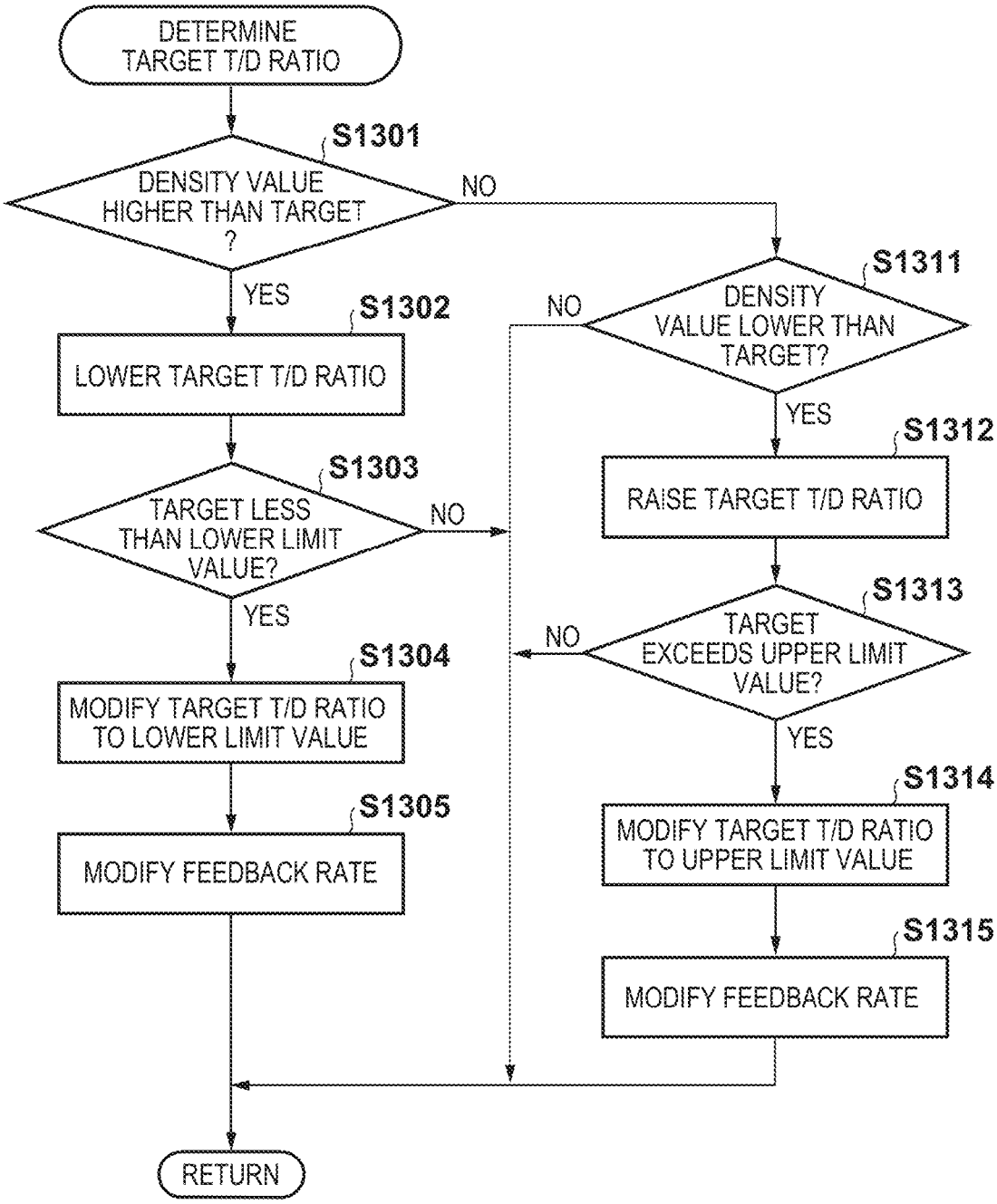
FIG. 13 is a flowchart illustrating a process for determining a target T/D ratio.

A method for determining the target T/D ratio that includes a process for modifying the feedback rate will be described using FIG. 13. This flowchart illustrates S1113, shown in FIG. 11B, in detail.

In S1301, the T/D ratio determination unit 307 compares the density value measured from the ATR chart 1000 to the target density value, and determines whether or not the measured density value is higher than the target density value. The process advances to S1302 in the case where the measured density value is higher than the target density value.

In S1302, the T/D ratio determination unit 307 lowers the target T/D ratio set in the replenishment control unit 308 by one level. The T/D ratio determination unit 307 lowers the target T/D ratio by 1%, for example. In this manner, the T/D ratio determination unit 307 functions as a unit that lowers the target value in the case where the density value obtained by the pattern sensor 317 is higher than the target density value. In S1303, the T/D ratio determination unit 307 determines whether or not the target T/D ratio is lower than the lower limit value. The process advances to S1304 in the case where the target T/D ratio is lower than the lower limit value. In S1304, the T/D ratio determination unit 307 modifies the target T/D ratio to the lower limit value (that is, substitutes the lower limit value for the target T/D ratio). In this manner, the T/D ratio determination unit 307 functions as a unit that modifies the target T/D ratio to the lower limit value in the case where the target T/D ratio set in accordance with the density value of the ATR chart 1000 is lower than the lower limit value of the predetermined range. In S1305, the feedback rate determination unit 309 modifies the feedback rate. In S1305, the feedback rate determination unit 309 increases the feedback rate in a relative manner, as described above (example: 5%→10%).

Meanwhile, the process advances to S1311 in the case where the density value measured in S1301 is not higher than the target density value. In S1311, the T/D ratio determination unit 307 compares the density value measured from the ATR chart 1000 to the target density value, and determines whether or not the measured density value is lower than the target density value. The process advances to S1312 in the case where the measured density value is lower than the target density value.

In S1312, the T/D ratio determination unit 307 raises the target T/D ratio set in the replenishment control unit 308 by one level. The T/D ratio determination unit 307 raises the target T/D ratio by 1%, for example. In this manner, the T/D ratio determination unit 307 functions as a unit that raises the target value in the case where the density value detected by the pattern sensor 317 is lower than the target density value. In S1313, the T/D ratio determination unit 307 determines whether or not the target T/D ratio is higher than the upper limit value. The process advances to S1314 in the case where a target T/D ratio is higher than the upper limit value. In S1314, the T/D ratio determination unit 307 modifies the target T/D ratio to the upper limit value (that is, substitutes the upper limit value for the target T/D ratio). In this manner, the T/D ratio determination unit 307 functions as a unit that modifies the target T/D ratio to the upper limit value in the case where the target T/D ratio determined in accordance with the density value of the ATR chart 1000 is higher than the upper limit value of the predetermined range. In S1315, the feedback rate determination unit 309 modifies the feedback rate. In S1315, the feedback rate determination unit 309 increases the feedback rate in a relative manner, as described above (example: 5%→10%).

The image forming apparatus 100 according to the present embodiment as described thus far controls the amount of toner with which the developing unit 4 is to be replenished from the toner receptacle 330 in accordance with the T/D ratio of the developing unit 4. The image forming apparatus 100 determines the target T/D ratio in accordance with the density value of the ATR chart 1000 formed on the intermediate transfer belt 51. Furthermore, the image forming apparatus 100 controls the conversion conditions by feeding back the density value of the tone chart 800 formed on the intermediate transfer belt 51. In particular, the image forming apparatus 100 sets a correction condition for correcting the conversion conditions to a first correction condition in the case where the target T/D ratio is within the predetermined range, and sets the correction condition for correcting the conversion conditions to a second correction condition, whose correction amount for a predetermined signal value is greater than that of the first correction condition, in the case where the target T/D ratio is outside of the predetermined range. Through this, the stability of maximum densities can be maintained even if the ratio between the toner and the carrier has been restricted to the predetermined range. The image forming apparatus 100 corrects the conversion conditions so that the density of the toner image increases in the case where the density value obtained by the pattern sensor 317 is lower than the target density value, and corrects the conversion conditions so that the density of the toner image decreases in the case where the density value obtained by the pattern sensor 317 is higher than the target density value. The conversion conditions are, for example, the PreGLUT 305, which is a lookup table that manages the allocation of dithering patterns. Note that the image forming apparatus 100 changes the dithering pattern allocated to the density signal so as to increase the density of the toner image in the case where the density value obtained by the pattern sensor 317 is lower than the target density value. Likewise, the image forming apparatus 100 changes the dithering pattern allocated to the density signal so as to reduce the density of the toner image in the case where the density value obtained by the pattern sensor 317 is higher than the target density value.

The image forming apparatus 100 can suppress toner scatter, fogging, and so on by modifying the target T/D ratio to the upper limit value in the case where the target T/D ratio determined in accordance with the density value of the ATR chart 1000 exceeds the upper limit value.

Likewise, the image forming apparatus 100 can suppress ghosting, carrier adhesion, and so on by modifying the target T/D ratio to the lower limit value in the case where the target T/D ratio determined in accordance with the density value of the ATR chart 1000 is lower than the lower limit value.

The image forming apparatus 100 lowers the target T/D ratio in the case where the density value obtained by the pattern sensor 317 is higher than the target density value and raises the target T/D ratio in the case where the density value obtained by the pattern sensor 317 is lower than the target density value. Through this, the T/D ratio of the developing material in the developing unit 4 is controlled correctly.

In the present embodiment, the T/D ratio of the developing material is detected using an inductance sensor so as to detect the magnetic permeability when the developing material is in a mixed state; however, the method for detecting the T/D ratio in the present invention is not limited thereto. In other words, a sensor that detects another physical amount that correlates with the T/D ratio may be used.

Second Embodiment

In the multitone control according to the first embodiment, the allocation of dithering patterns to density signals is changed (that is, the laser exposure time is changed) as a measure when the maximum density has shifted from the target density (S1103). In a second embodiment, however, the laser power is controlled in a variable manner in the multitone control as a measure when the maximum density has shifted from the target density.

Figure 14:
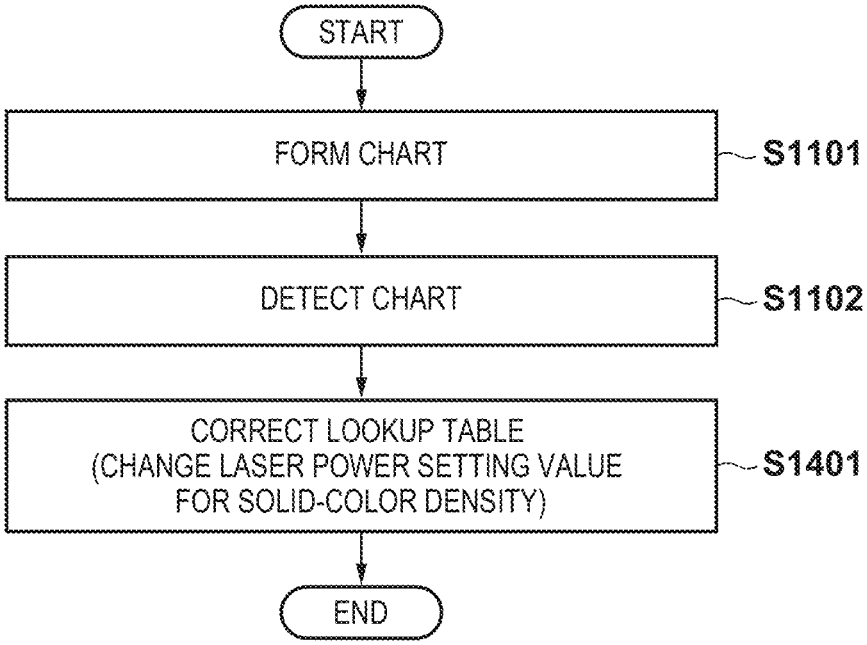
FIG. 14 is a flowchart illustrating multitone control.

FIG. 14 illustrates the multitone control according to the second embodiment, where S1103 has been replaced with S1401. In S1401, the multitone control unit 306 corrects a lookup table. However, in the case where the measured maximum density is higher than the target density by no less than a predetermined value, the maximum density control unit 301 lowers the laser power setting value by one step. In the case where the measured maximum density is lower than the target density by no less than a predetermined value, the maximum density control unit 301 raises the laser power setting value by one step. "One step" corresponds to one of the seven levels shown in FIG. 4. Although the laser power can be controlled across seven levels in the second embodiment, the number of levels across which the laser power can be controlled may be determined as appropriate. In the case where the resolution of the laser power setting value is 9 bits, the maximum density control unit 301 may change the laser power setting value one level at a time in a range from 0 to 511. Note that halftones aside from the maximum density are corrected using the feedback rate for the PreGLUT 305 as described above.

As described in the first embodiment, the PreGLUT 305 is corrected so as to lower the density in the case where the measured maximum density is higher than the target density (that is, the dithering pattern may be changed). In other words, in the case where the density of an image formed using a predetermined laser power is higher than a desired density, the exposure time may be shortened. However, shortening the exposure time may produce jaggies in text, lines, and so on, which in turn can reduce the image quality. Accordingly, the maximum density control unit 301 can suppress the exposure time from being shortened excessively by changing the laser power setting value.

On the other hand, the PreGLUT 305 is corrected so as to raise the density in the case where the measured maximum density is lower than the target density (that is, the dithering pattern may be changed). In this manner, although the correction can be carried out by reducing the amount by which the exposure time is shortened, the maximum density cannot be corrected if the amount by which the exposure time is shortened has been lowered to a lower limit. Accordingly, control for changing the laser power setting value and control for changing the dithering pattern may be carried out in tandem.

Correction of Target T/D Ratio in ATR Control

Figure 15:
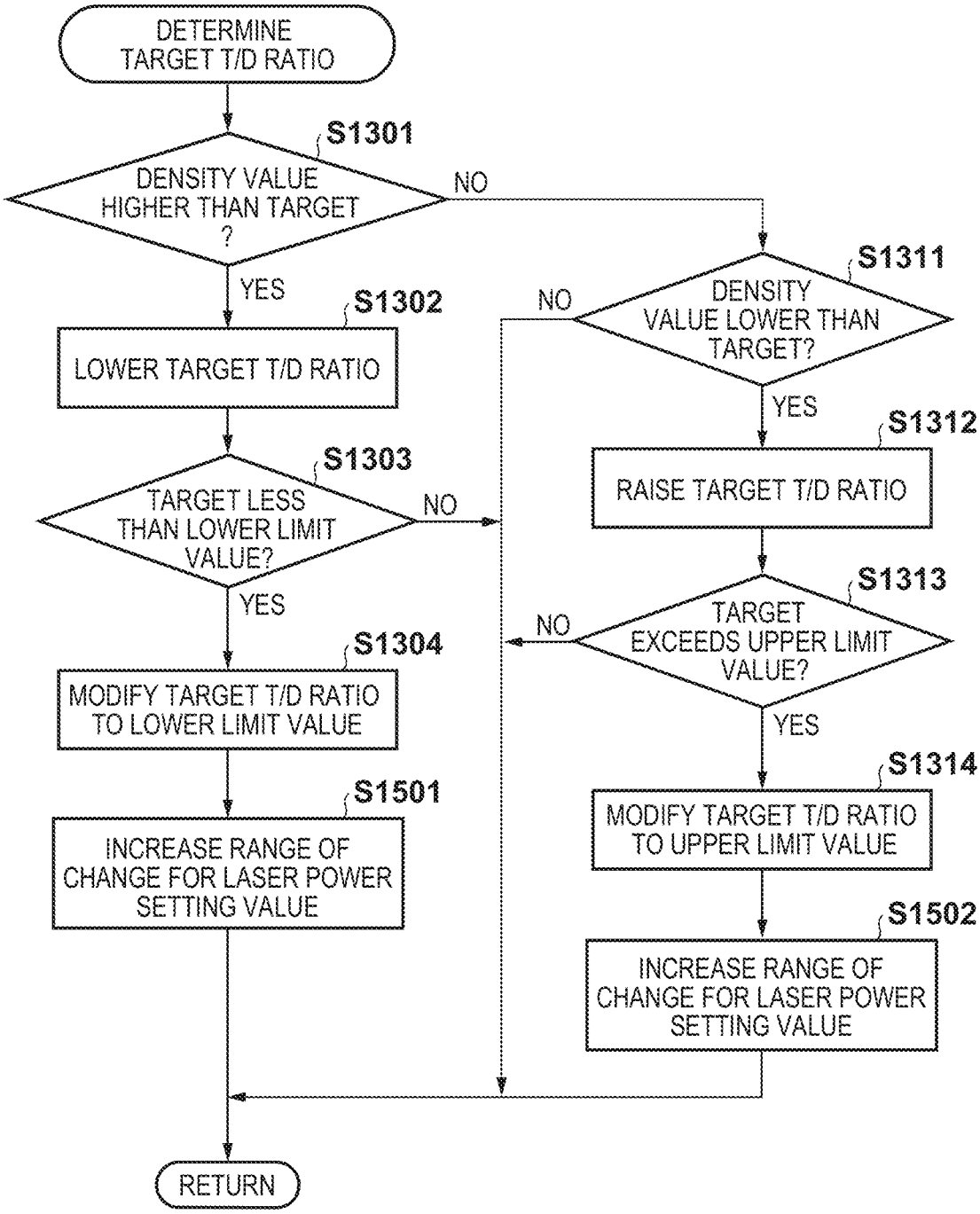
FIG. 15 is a flowchart illustrating a process for determining a target T/D ratio.

In the second embodiment, the maximum density control unit 301 may increase the range across which the laser power setting value is changed in the case where the target T/D ratio cannot be corrected using the T/D ratio limiters in the ATR control. FIG. 15 illustrates a method for determining the target T/D ratio according to the second embodiment. For example, in the case where the measured maximum density is lower than the target density by no less than a predetermined value, the maximum density control unit 301 raises the range across which laser power setting value is changed, and raises the laser power setting value by two steps, in S1501. On the other hand, in the case where the measured maximum density is higher than the target density by no less than a predetermined value, the maximum density control unit 301 raises the range across which laser power setting value is changed, and lowers the laser power setting value by two steps, in S1502. In this manner, the maximum density control unit 301 includes an increasing unit that increases the range across which the laser power setting value is changed. The feedback rate determination unit 309 may manage the increase in the range of the change. Accordingly, the maximum density control unit 301, the feedback rate determination unit 309, and so on function as a unit that increases the range of change for an exposure amount, serving as an image forming condition, when the target T/D ratio is outside of the range from the upper limit value to the lower limit value.

As described above, in a situation where the target T/D ratio is set to the T/D ratio limiters and cannot be corrected any further, the toner charge amount may not stabilize and engine density fluctuations may increase. It is especially easy for the maximum density to become unstable in such a situation, where the toner charge amount is unstable. Accordingly, the image forming apparatus 100 increases the range of change for the exposure amount, which is an image forming condition, in the case where the target T/D ratio is outside of the predetermined range. In other words, the color can be stabilized by increasing the range across which the laser power setting value is changed in addition to correcting the PreGLUT 305.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2013-184339, filed Sep. 5, 2013 and 2014-161898, filed Aug. 7, 2014, which are hereby incorporated by reference herein in their entirety.

What is claimed is:

1. An image forming apparatus comprising:

a conversion unit configured to convert image data using a conversion condition;

an image forming unit configured to form an image based on the image data converted by the conversion unit, the image forming unit including an image carrier, an exposure unit configured to expose the image carrier to form an electrostatic latent image, a developing unit configured to develop the electrostatic latent image by using developing material that includes toner and carrier, and an intermediate transfer member onto which the image that is formed on the image carrier is transferred;

a detection unit configured to detect a toner density of the developing material in the developing unit;

a replenishing unit configured to replenish the toner in the developing unit;

a replenishment control unit configured to, based on the toner density detected by the detection unit and a target density, control the replenishing unit;

a measurement unit configured to measure a measurement image formed on the intermediate transfer member by the image forming unit;

a first determination unit configured to control the image forming unit to form a first measurement image, control the measurement unit to measure the first measurement image, and determine the target density based on a measuring result of the first measurement image;

a correction unit configured to control the image forming unit to form a second measurement image, control the measurement unit to measure the second measurement image, and correct the conversion condition based on a measuring result of the second measurement image and a correction condition; and a second determination unit configured to determine the correction condition based on the target density determined by the first determination unit.

2. The image forming apparatus according to claim 1, wherein the second determination unit is further configured to determine a first correction condition as the correction condition in the case where the target density determined by the first determination unit is within a predetermined range, and determine a second correction condition that is different from the first correction condition as the correction condition in the case where the target density determined by the first determination unit is outside of the predetermined range.

3. The image forming apparatus according to claim 2, wherein a correction amount by which the conversion condition corrected based on the second correction condition corrects a predetermined input value is greater than a correction amount by which the conversion condition corrected based on the first correction condition corrects the predetermined input value.

4. The image forming apparatus according to claim 1, wherein the conversion condition is a lookup table that manages the allocation of dithering patterns;

the correction condition is a feedback rate for the lookup table; and the second determination unit is further configured to set the feedback rate to a first value in the case where the target density is within a predetermined range and set the feedback rate to a second value that is greater than the first value in the case where the target density is outside of the predetermined range.

5. The image forming apparatus according to claim 4, wherein the lookup table that manages the allocation of the dithering patterns is configured by combining two lookup tables.

6. The image forming apparatus according to claim 1, wherein in the case where the target density determined by the first measurement image exceeds an upper limit value of a predetermined range, the first determination unit modifies the target density to the upper limit value.

7. The image forming apparatus according to claim 6, wherein the replenishment control unit is configured to control the replenishment unit based on the toner density detected by the detection unit and the modified target density.

8. The image forming apparatus according to claim 1, wherein in the case where the target density determined in accordance with a measuring result of the first measurement image is lower than a lower limit value of a predetermined range, the first determination unit modifies the target density to the lower limit value.

9. The image forming apparatus according to claim 8, wherein the replenishment control unit is configured to control the replenishment unit based on the toner density detected by the detection unit and the modified target density.

10. The image forming apparatus according to claim 1, wherein the first determination unit is further configured to increase the target density in the case where the measuring result of the first measurement image is lower than a target result and decrease the target density in the case where the measuring result of the first measurement image is greater than the target result.

11. The image forming apparatus according to claim 1, wherein the correction unit is further configured to correct the conversion condition so as to increase the density of the image to be formed by the image forming unit in the case where the measuring result of the second measurement image is lower than a target result and correct the conversion condition so as to reduce the density of the image to be formed by the image forming unit in the case where the measuring result of the second measurement image is higher than the target result.

12. The image forming apparatus according to claim 11, wherein the conversion unit includes a lookup table configured to convert a density signal, and a dithering unit configured to select a dithering pattern based on the density signal converted by the lookup table and execute a dithering process; and the correction unit is further configured to change the allocation of the dithering patterns to the density signal so as to increase the density of the image to be formed by the image forming unit in the case where the measuring result of the second measurement image is lower than the target result and change the allocation of the dithering patterns to the density signal so as to reduce the density of the image to be formed by the image forming unit in the case where the measuring result of the second measurement image is higher than the target result.

13. The image forming apparatus according to claim 1, wherein the detection unit includes a magnetic permeability detection unit that detects a magnetic permeability of the developing material in the developing unit.

14. The image forming apparatus according to claim 1, wherein the detection unit is further configured to detect a ratio of the toner mass to the total mass of the developing material that contains toner and carrier as the toner density.

15. The image forming apparatus according to claim 1, wherein the replenishment control unit is configured to control an amount of the toner to be replenished into the developing unit by the replenishing unit based on the toner density detected by the detection unit and the target density.

* * * * *